US005761941A

United States Patent [19]

Matsui et al.

[11] Patent Number: 5,761,941

[45] Date of Patent: Jun. 9, 1998

[54] LUBRICANT COMPOSITION FOR CRYOGENIC FORMING OF ALUMINUM OR ALUMINUM ALLOY SHEETS

[75] Inventors: Kuniaki Matsui; Tomoyuki Sugita, both of Mooka; Takehiko Ichimoto, Wakayama, all of Japan

[73] Assignees: Kabushiki Kaisha Kobe Seiko Sho, Hyogo; Kao Corporation, Tokyo, both of Japan

[21] Appl. No.: 576,754

[22] Filed: Dec. 21, 1995

[30] Foreign Application Priority Data

Dec. 22, 1994 [JP] Japan ..... 6-319637

[51] Int. Cl.[6] ..... B21B 45/02

[52] U.S. Cl. ..... 72/42

[58] Field of Search ..... 72/42, 39, 41; 252/42, 49.8, 32.7, 46, 56; 508/583

[56] References Cited

U.S. PATENT DOCUMENTS

| | | | |
|---|---|---|---|
| 3,649,537 | 3/1972 | Hotten | 508/583 |
| 4,132,662 | 1/1979 | Sturwold | 72/42 |
| 5,064,546 | 11/1991 | Dasai | 508/583 |
| 5,124,055 | 6/1992 | Perozzi | 252/46.7 |
| 5,240,622 | 8/1993 | Nesvadba | 252/49.8 |
| 5,298,178 | 3/1994 | O'Neil et al. | 252/49.3 |
| 5,320,764 | 6/1994 | Camenzind et al. | 252/32.7 |
| 5,354,486 | 10/1994 | Evans | 252/57 |

FOREIGN PATENT DOCUMENTS

| | | |
|---|---|---|
| 6-389649 | 4/1988 | Japan . |
| 3-134094 | 6/1991 | Japan . |
| 4-233998 | 8/1992 | Japan . |
| 4300032 | 10/1992 | Japan . |
| 598274 | 4/1993 | Japan . |

*Primary Examiner*—Lowell A. Larson
*Assistant Examiner*—Rodney Butler
*Attorney, Agent, or Firm*—Birch, Stewart, Kolasch & Birch, LLP

[57] ABSTRACT

The present invention relates to a lubricant composition for press-forming an aluminum or aluminum alloy sheet at low temperatures. The composition contains a component (a): 45 to 90% by weight of one or more hydrocarbons selected from the group consisting of mineral oils, synthetic naphthenes, polybutenes, and poly(mono)α-olefins, and component (b): 10 to 45% by weight of one or more C10–C24 linear or branched fatty alcohols. The ester value of the composition is not more than 70, and the kinematic viscosity is less than 20 cSt at 40° C. When this composition is used in forming aluminum or aluminum alloy sheets, enhanced formability can be obtained, and shapes which could not obtained conventionally can be formed.

6 Claims, No Drawings

LUBRICANT COMPOSITION FOR CRYOGENIC FORMING OF ALUMINUM OR ALUMINUM ALLOY SHEETS

BACKGROUND OF THE INVENTION

1. Field of the Invention

The present invention relates to forming of aluminum or aluminum alloy sheets, and more particularly to lubricant compositions which provide excellent formability in cryogenic forming of aluminum products having complicated shapes such as automobile parts, electric appliances, and aircraft parts. The invention also relates to aluminum or aluminum alloy sheets produced by cryogenic forming using the lubricant compositions, and to a method for forming aluminum or aluminum alloys using the lubricant composition.

2. Background Art

Aluminum and aluminum alloys are used in a wide variety of fields such as the automotive industry as general-purpose metal materials, second to iron and steel materials due to their light weight, corrosion resistance, and formability.

Recently, use of aluminum sheets and aluminum alloy sheets has gradually increased because the weight of automobiles can be reduced. However, since aluminum sheets and aluminum alloy sheets have less formability than steel sheets, they have the drawback that they may crack when they undergo press-forming and that limitations are imposed on the design of the shape of the product into which the sheets will be formed.

To solve these problems, a variety of materials have been developed which include Al—Mg13 Zn alloys described in Japanese Patent Application Laid-open (kokai) No. 63-89649 (1988). However, formability of these alloys is still inferior to that of steel.

Japanese Patent Application Laid-open (kokai) No. 4-300032 (1992) discloses an improved method of forming. According to this method, formability is enhanced as a result of making use of the good elongation property of aluminum and aluminum alloys in a low temperature range. However, it is not clear what performance is required for a lubricant used in this method. In addition, formability obtained by this method is still not comparable to that of steel. As regards lubricants, Japanese Patent Application Laid-open (kokai) No. 3-134094 (1991), Japanese Patent Application Laid-open (kokai) No. 4-233998 (1992), and Japanese Patent Application Laid-open (kokai) No. 5-98274 (1993) disclose a number of lubricants in which esters, alcohols, etc. are incorporated. Even with these lubricants, there is still the problem that formability comparable to that obtained by the use of steel cannot be achieved.

In view of the foregoing, the present inventors have conducted extensive studies, and found that the above-mentioned problems can be solved by using a lubricant having a specific composition and properties, leading to the accomplishment of the present invention.

SUMMARY OF THE INVENTION

Accordingly, an object of the present invention is to solve the above-discussed problems and to provide a lubricant composition for cryogenic forming of aluminum or aluminum alloy sheets.

In one aspect of the present invention, there is provided a lubricant composition used for press-forming aluminum or aluminum alloy sheets at a temperature less than −30° C., comprising the following components (a) and (b):

(a) 45 to 90% by weight of one or more hydrocarbons selected from the group consisting of mineral oils, synthetic naphthenes, polybutenes, and poly(mono)α-olefins, and (b) 10 to 45% by weight of one or more C10–C24 linear or branched fatty alcohols, wherein the ester value of the composition is not more than 70, and the kinematic viscosity at 40° C. is less than 20 cSt.

The present invention also provides an aluminum or aluminum alloy sheet which is coated with the lubricant composition and which is to be formed at a low-temperature.

Moreover, the present invention provides a method of forming aluminum or aluminum alloy sheets at a low temperature which comprises steps of applying the lubricant composition to an aluminum or aluminum alloy sheet and press-forming the resulting sheet at a temperature less than −30° C.

The above and other objects, features, and advantages of the present invention will become apparent from the following description.

DETAILED DESCRIPTION OF THE INVENTION

The component (a) of the composition of the present invention serves as a diluent. It is primarily effective in controlling the kinematic viscosity and ester values of the lubricant composition of the invention. Particularly, it plays an important role in making the lubricant composition waxy at a forming temperature (less than −30° C., and preferably less than −100° C.). In cryogenic forming, if a lubricant composition is crystallized or becomes rubbery at a forming temperature, the composition cannot be satisfactorily spread over the surfaces of the sheets, and therefore, sufficient lubricity cannot be obtained and formability is reduced. Esters are not suitable as diluents because they become rubber-like at low temperatures. Taking account of the lubricity of a diluent itself and its manageability (liquid at ambient temperature), the component (a) is most preferably C12–C20 α-olefins. The component (a) may be used singly or in combination of two or more. It is preferably incorporated in an amount of 45–90% by weight, and particularly 50–70% by weight from the viewpoint of controlling the form of the lubricant composition at the forming temperature.

The component (b), a fatty alcohol, enhances oiliness of the composition when applied to aluminum and aluminum alloys and also imparts formability at a low termperature. Examples of the fatty alcohol include saturated linear alcohols such as lauryl alcohol and myristyl alcohol; unsaturated linear alcohols such as oleyl alcohol; branched alcohols such as isostearyl alcohol, oxoalcohols, and Guerbet alcohols; and natural alcohols obtainable from natural oils and fats.

If the fatty alcohol has less than 10 carbon atoms, sufficient oiliness enhancing effect cannot be obtained. On the other hand, if the carbon number is in excess of 24, the fatty alcohol tends to precipitate in the lubricant composition, and in addition, handling of the composition becomes difficult.

Of the listed fatty alcohols, unsaturated linear alcohols such as oleyl alcohol; and branched alcohols such as C13-oxoalcohol and 2-octyldodecanol are more preferred.

The component (b) is preferably incorporated into the lubricant composition of the present invention in an amount of 10–45% by weight, particularly 20–40% by weight. An amount less than 10% by weight provides insufficient oiliness enhancing effect, whereas an amount in excess of 45% will make the lubricant composition crystallize at low temperatures, hindering sufficient formability.

When the composition of the present invention contains one or more species of the following component (c) in addition to the above mentioned components (a) and (b), lubricating performance of the composition can be even more improved. The component (c) is selected from the group consisting of (1) oils and fats, (2) one or more esters of a polyol and a C12–C24 fatty acid, and (3) esters having a weight-average molecular weight of 750 to 7,500 obtained from reacting a C12–C24 alcohol or a fatty acid with residual carboxyl groups or hydroxyl groups of an ester of one or more dimer acids or polymer acids of C16–C20 unsaturated fatty acids and a polyol.

The above-mentioned oils and fats (1) of the component (c) are natural oils and fats which predominantly contain fatty triglycerides, examples of which include beef tallow, lard, palm oil, soybean oil, coconut oil, and castor oil.

The polyol serving as a constituent of the esters (2) of the component (c) has 2 or more alcoholic hydroxyl groups in one molecule. Examples of such polyol include C2–C8 dihydric to hexahydric alcohols such as ethylene glycol, propylene glycol, neopentyl glycol, trimethylol propane, glycerol, pentaerythritol, and sorbitol. Examples of the other constituent, a C12–C24 higher fatty acid, include lauric acid, stearic acid, isostearic acid, oleic acid, and erucic acid. In some esters (2), all the hydroxyl groups contained in the polyol are esterified, and in others, part of the hydroxyl groups are esterified. In the present invention, both types of esters are advantageously used.

The dimer acids or polymer acids in (3) of component (c) are dimer acids or polymer acids of C16–C20 higher fatty monoene acids or diene acids, examples of which include dimer acids or polymer acids of somarine acid, oleic acid, linoleic acid, and gadleic acid. Examples of polyols which form esters together with these dimer acids and polymer acids include C2–C8 dihydric to hexahydric alcohols such as ethylene glycol, diethylene glycol, propylene glycol, trimethylolpropane, pentaerythritol, glycerol, and sorbitol. Examples of C12–C24 alcohols include lauryl alcohol, myristyl alcohol, stearyl alcohol, and oleyl alcohol. Examples of C12–C24 fatty acids include lauric acid, palmitic acid, stearic acid, oleic acid, and coconut oil fatty acid. Among the esters obtained from the above components, it is necessary that those having a weight-average molecular weight of 750–7,500 be used in the present invention. If the weight-average molecular weight is less than 750, lubricity becomes poor. On the other hand, if it is in excess of 7,500, compatibility with other components of the composition decreases, which is not preferable. Preferred esters include those obtained by esterifying, with stearyl alcohol, free carboxyl radicals of an ester of a polymer acid of oleic acid and diethylene glycol; those obtained by esterifying, with oleic acid, residual hydroxyl radicals of an ester of a dimer acid of oleic acid and trimethylolpropane; and those obtained by esterifying, with coconut oil fatty acid, residual hydroxyl radicals of an ester of a polymer acid of oleic acid and pentaerythritol.

Since the component (c) generally has a high viscosity and excellent lubricating property, it functions as a viscosity controlling component in the present invention. However, if it is used in excessive amounts, the viscosity becomes too high. In addition, use in excessive amounts makes the resulting lubricant composition rubber-like at a forming temperature. Moreover, oil removal becomes difficult, which may result in contamination of the formed product. Therefore, the component (c) is preferably incorporated in an amount less than 30% by weight, and preferably from 10–30% by weight of the total lubricant composition. In addition, it is preferred that the amount of component (c) be less than component (b).

In the present invention, it is necessary that the lubricant composition prepared by blending the components in the aforementioned proportion have an ester value [measurement method: ester value=saponification value (JIS K 2503)–acid value (JIS K 2501)] of not more than 70. If the ester value is in excess of 70, cryogenic formability decreases as mentioned before. Also, the kinematic viscosity (measurement method: JIS K 2283) must be less than 20 cSt (at 40° C.). The kinematic viscosity of not less than 20 cSt (at 40° C.) makes it difficult to remove oils.

The lubricant composition for use in cryogenic forming may further include, if it is desired, additives which are ordinarily incorporated in lubricant composition such as antirusting/corrosion preventing agents, antioxidants, and surfactants.

In more detail, the antirusting/corrosion preventing agents include alkenyl succinic acids and their derivatives, fatty acids such as oleic acid, esters such as sorbitan monooleate, and amines; the antioxidants include phenolic compounds such as 2,4-di-tert-butyl-p-cresol and aromatic amines such as phenyl-α-naphthylamine; and the surfactants include nonionic surfactants such as polyoxyethylene nonylphenyl ether and polyoxyethylene alkyl amine.

In use of the lubricant composition for cryogenic forming of the present invention, it is preferably applied to aluminum or aluminum alloy sheets in an amount of 0.5–5.0 g/m$^2$, and more preferably 1.0–2.0 g/m$^2$. If the amount is less than 0.5 g/m$^2$, lubricity becomes poor and cracks tend to occur. On the other hand, if the lubricant composition is used in an amount in excess of 5.0 g/m$^2$, it is wasteful as the composition in excess will simply flow away.

According to the present invention, the aluminum and aluminum alloys are not particularly limited as to their quality, etc. They can be selected so as to have a suitable composition of proper components in accordance with the performance to be met by the final product. For example, if a product with high strength is needed, Al-high Mg (3–6% Mg) alloys may be used.

According to the forming method of the present invention, aluminum or aluminum alloy sheets are subjected to press-forming after they are coated with the lubricant composition of the invention and cooled at a temperature lower than −30° C., preferably lower than −100° C. The lubricant composition may be applied to the sheets by any method. However, it is preferred that aluminum or aluminum alloy sheets are soaked in a bath of the present composition, then they are pulled out and excessive amounts of the composition is removed from the surfaces using a roller so that a certain amount of the composition (for example, 0.5 to 5.0 g/m$^2$) remains thereon.

EXAMPLES

The present invention will next be described by way of examples which should not be construed as limiting the invention.

Example 1

The lubricant compositions shown in Table 1 were prepared by a conventional method. Each of them was applied to a test sheet (material: JIS5182-O, sheet thickness: 1.0 mm) in an amount of 2 g/m$^2$. Subsequently, the test sheet was soaked in liquid nitrogen and then removed. After it returned to a predetermined temperature, formability and readiness in oil removal were evaluated. The results are also shown in Table 1.

In evaluating formability, a 80 tonf mechanical press was used. Under the press, a deep drawing test was performed with a square cylinder, in which a maximum amount (height) of forming without cracks was evaluated.

Forming Conditions:

Punch size: 90 mm×90 mm (square cylinder)

Blank size: 200 mm×200 mm

Blank holding force: 6.5 tonf

Speed: 300 mm/sec

Amount of lubricant composition: About 2 g/m$^2$

Temperature: −100° C., −150° C.

Readiness in removing oils was evaluated by an area (%) representing wetting after each test sheet was treated with the following cleaner and conditions. The number of sheets tested was 3, and their mean value was used for evaluation. 80% or more values indicate good property of readiness in removing oils.

Conditions of removing oils:

Cleaner: A solution containing 2% NaOH and 0.2% polyoxyethylene nonylphenyl ether (HLB=12.4)

Oil removing temperature: 40° C.

Method of removing oils: Spray-washing (1 kgf/cm$^2$, 1 liter/min×2 min)

Rinsing method: Spray-rinsing with 40° C. water (1 liter/min×1 min)

Hydrocarbon A: paraffin-type mineral oil (10 cSt/40° C.)

Hydrocarbon B: polybutene (Mw=300, 10 cSt/40° C.)

Hydrocarbon C: C10 α-olefin

Hydrocarbon D: C14 α- olefin

Hydrocarbon E: polyα-olefin (6 cSt/40° C.)

Alcohol A: lauryl alcohol

Alcohol B: C13 oxoalcohol

Alcohol C: C20 Guerbet alcohol

Alcohol D: stearyl alcohol (mp=59° C., acid value=0.1, iodine value=1.0)

Ester A: palm oil

Ester B: pentaerythritol tetraoleate

Ester C: glycerol monooleate

Ester D: ester obtained by condensing with heat an ester of 100 g of a polymer acid of oleic acid (dimer acid: trimer or higher acids=6:4) and 12 g of diethylene glycol along with 38 g of stearyl alcohol (Mw=1,800)

Ester E: pentaerythritol hydrogenated coconut oil fatty acid tetraester (mp=43° C., acid value=0.1, hydroxyl value=5, and iodine value=0.3)

Ester F: glycerol trimyristate (mp=48° C., acid value=0.1)

Others—A: oleic acid

Others—B: ethylene oxide (2 mol) adduct of stearyl amine

Others—C: mixture of a Ca salt of synthetic sulfonate and a Ba salt of petroleum sulfonate (2:1)

TABLE 1

| | Lubricant Composition (% by weight) | | | | | | | | | | | | | Kinematic | Ester value | formability (mm) | | Oil |
|---|---|---|---|---|---|---|---|---|---|---|---|---|---|---|---|---|---|---|
| | Hydrocarbons | | | | | Alcohols | | | Esters | | | | | viscosity | (KOH | −100 | −150 | Removal |
| | A | B | C | D | E | A | B | C | A | B | C | D | Others | (cSt/40° C.) | mg/g) | (°C.) | (°C.) | (%) |
| Invention Product Nos. | | | | | | | | | | | | | | | | | | |
| 1 | 60 | | | | | 20 | | | 20 | | | | | 13.5 | 40 | 32 | 38 | 85 |
| 2 | 60 | | | | | | 20 | | | 20 | | | | 14.6 | 38 | 32 | 38 | 80 |
| 3 | 60 | | | | | | | 20 | | | 20 | | | 17.5 | 32 | 32 | 39 | 80 |
| 4 | 50 | | | | | 20 | | | | 30 | | | | 13.8 | 57 | 32 | 39 | 85 |
| 5 | 60 | | | | | 10 | | | 30 | | | | | 16.4 | 57 | 32 | 38 | 80 |
| 6 | | 60 | | | | | | 20 | | 20 | | | | 16.2 | 38 | 32 | 38 | 80 |
| 7 | | | 60 | | | | | 20 | | 20 | | | | 7.2 | 38 | 36 | 42 | 90 |
| 8 | | | | | 60 | | | 20 | | 20 | | | | 11.5 | 38 | 33 | 38 | 85 |
| 9 | 48 | | | | | | | 20 | | 30 | | | A: 2 | 19.9 | 57 | 32 | 38 | 80 |
| 10 | | | | 80 | | | | 20 | | | | | | 2.5 | 0 | 34 | 41 | 95 |
| 11 | | | 80 | | | | | 20 | | | | | | 4.5 | 0 | 35 | 42 | 95 |
| 12 | | | 50 | | | | 40 | | | | 10 | | | 5.5 | 16 | 36 | 42 | 90 |
| 13 | | | 90 | | | | | 10 | | | | | | 3.1 | 0 | 35 | 41 | 95 |
| 14 | | | 70 | | | | | 20 | | | 10 | | | 4.6 | 16 | 36 | 42 | 90 |
| 15 | | | 70 | | | | | 20 | | | | 10 | | 6.0 | 18 | 36 | 42 | 90 |
| 16 | | | 50 | | | | | 20 | | 30 | | | | 9.9 | 57 | 36 | 42 | 85 |
| 17 | | | 68 | | | | | 20 | | 10 | | | B: 2 | 5.0 | 19 | 35 | 42 | 95 |
| Comparative Product Nos. | | | | | | | | | | | | | | | | | | |
| 1 | Commercially obtained press oil | | | | | | | | | | | | | 3.9 | 12 | 22 | 34 | 95 |
| 2 | 50 | | | | | | | | | 35 | | | C: 15 | 25.0 | 66 | 29 | 35 | 75 |
| 3 | | 90 | | | | | | | | | | | D: 10 | 3.3 | 5 | 28 | 36 | 90 |
| 4 | Ester E: 100 | | | | | | | | | | | | | 68.8 | 259 | 29 | 35 | 70 |
| 5 | Ester F: 100 | | | | | | | | | | | | | — | 198 | 29 | 35 | 50 |
| 6 | Alcohol D: 100 | | | | | | | | | | | | | — | 0 | 26 | 35 | 50 |
| 7 | Liquid paraffin (pour point = −30° C.): 100 | | | | | | | | | | | | | 3.0 | 0 | 25 | 36 | 95 |

In the above table, lubricant components represented by alphabets are as follows.

Others—D: ethylene oxide (20 mol) adduct of butyl stearate

Commercially obtained press oil:
mineral oil: 91% by weight
oxidized wax ester: 6% by weight
petroleum sulfonate Na: 3% by weight As is apparent from Table 1, when lubricant compositions according to the present invention are used in cryogenic forming of aluminum or aluminum alloys, excellent formability far superior to that of the comparative products was obtained. In addition, oils were readily removed when the products of the invention were used.

As described above, the lubricant composition of the present invention is useful in forming aluminum or aluminum sheets at low temperatures as it is capable of greatly increasing formability. Accordingly, with the lubricant composition of the invention, it is possible to form sheets into complicated shapes which could not be achieved conventionally. Moreover, due to the enhanced formability, the number of steps in forming can be reduced, increasing productivity and reducing costs for metal dies.

What is claimed is:

1. A lubricant composition for press-forming an aluminum or aluminum alloy sheet at a temperature less than −30° C., consisting essentially of the following components (a) and (b):

(a) 45 to 90% by weight of one or more hydrocarbons selected from the group consisting of mineral oils, synthetic naphthenes, polybutenes, and poly(mono)α-olefins, and (b) 10 to 45% by weight of one or more $C_{10}$–$C_{24}$ linear or branched fatty alcohols, said composition having an ester value of not more than 70, and a kinematic viscosity at 40° C. is less than 20 cSt.

2. The lubricant composition according to claim 1, which further comprises the following component (c):

(c) one or more members selected from the group consisting of (1) oils and fats, (2) one or more esters of a polyol and a C12–C24 fatty acid, and (3) esters having a weight-average molecular weight of 750 to 7,500 obtained from reacting a C12–C24 alcohol or a fatty acid with residual carboxyl groups or hydroxyl groups of an ester of one or more dimer acids or polymer acids of C16–C20 unsaturated fatty acids and a polyol.

3. The lubricant composition according to claim 1, wherein the hydrocarbons (a) are α-olefins having 12 to 20 carbon atoms.

4. The lubricant composition according to claim 1, wherein the fatty alcohols (b) are branched fatty alcohols having 12 to 24 carbon atoms.

5. The lubricant composition according to claim 2, wherein the component (c) is incorporated in an amount not more than 30% by weight.

6. The lubricant composition according to claim 2, wherein the component (a), component (b), and component (c) are contained in amounts of 50–70% by weight, 20–40% by weight, and 10–30% by weight, respectively.

* * * * *